US011274510B2

(12) United States Patent
Natarajan

(10) Patent No.: US 11,274,510 B2
(45) Date of Patent: Mar. 15, 2022

(54) PIPE LOADING SYSTEM

(71) Applicant: Caterpillar Global Mining Equipment LLC, Denison, TX (US)

(72) Inventor: Yagneshwar Natarajan, Chennai (IN)

(73) Assignee: Caterpillar Global Mining Equipment LLC, Denison, TX (US)

( * ) Notice: Subject to any disclaimer, the term of this patent is extended or adjusted under 35 U.S.C. 154(b) by 0 days.

(21) Appl. No.: 16/774,809

(22) Filed: Jan. 28, 2020

(65) Prior Publication Data

US 2021/0230952 A1 Jul. 29, 2021

(51) Int. Cl.

| | |
|---|---|
| ***E21B 19/16*** | (2006.01) |
| ***E21B 19/24*** | (2006.01) |
| ***E21B 19/06*** | (2006.01) |
| ***E02D 7/02*** | (2006.01) |

(52) U.S. Cl.

CPC ..... *E21B 19/16* (2013.01); *E02D 7/02* (2013.01); *E21B 19/06* (2013.01); *E21B 19/24* (2013.01)

(58) Field of Classification Search

None

See application file for complete search history.

(56) References Cited

U.S. PATENT DOCUMENTS

| | | | | |
|---|---|---|---|---|
| 3,799,009 | A * | 3/1974 | Guier | E21B 19/164 81/57.16 |
| 4,403,666 | A | 9/1983 | Willis | |
| 4,595,066 | A * | 6/1986 | Nelmark | E21B 19/20 175/52 |
| 4,654,950 | A * | 4/1987 | Maidlow | E21B 19/16 29/272 |
| 5,575,344 | A * | 11/1996 | Wireman | E21B 19/14 175/162 |
| 6,951,257 | B2 | 10/2005 | Comacchio | |
| 8,651,176 | B2 | 2/2014 | Angelle | |
| 9,765,581 | B2 * | 9/2017 | Smith | E21B 19/24 |
| 2003/0056986 | A1 * | 3/2003 | De Lille | E21B 19/155 175/52 |
| 2019/0017336 | A1 | 1/2019 | Saavedra | |

FOREIGN PATENT DOCUMENTS

CN 107237604 A 10/2017

* cited by examiner

*Primary Examiner* — Sean D Andrish

(57) ABSTRACT

A pipe loading system for a drilling machine includes a stem and a first receptacle adapted to removably receive a first end of a first pipe. The pipe loading system includes a guide ring removably disposed on the first receptacle and adapted to removably receive a first end of a second pipe. The pipe loading system also includes a second receptacle defining a first receiving portion and adapted to removably receive a second end of the first pipe. The pipe loading system further includes a liner assembly removably disposed on the second receptacle and defining a second receiving portion. The second receiving portion is adapted to removably receive a second end of the second pipe. A diameter of the second pipe is smaller than a diameter of the first pipe.

9 Claims, 8 Drawing Sheets

PIPE LOADING SYSTEM

TECHNICAL FIELD

The present disclosure relates to a pipe loading system. More particularly, the present disclosure relates to the pipe loading system associated with a drilling machine.

BACKGROUND

A drilling machine, such as a rotary blasthole drilling machine, includes one or more pipe loading systems. The pipe loading system is adapted to receive a drill pipe from a pipe loader for coupling the drill pipe to a drill motor or a drill string associated with the drilling machine. In many situations, the pipe loading system is designed to handle a single size, such as diameter and/or length, of the drill pipe and may not be flexible for drilling different sizes of holes, particularly within a few minutes of setup time. As a result, versatility and capability of such drilling machines may be limited. As such, in a situation, when a different size of the drill pipe may have to be employed to drill a different size of hole, the pipe loading system may have to be disassembled from the drill mast and another pipe loading system having a size configuration for the differently sized drill pipe may have to be assembled on the machine.

This process of disassembling and assembling the pipe loading system on the drilling machine may result in increased machine downtime, increased labor effort, increased costs, reduced productivity, and so on. Also, in many situations, multiple pipe loading systems having different size configurations may have to be stocked on a worksite in order to cater to differently sized drill pipes as may be required, in turn, increasing inventory and costs. Hence, there is a need for an improved pipe loading system for such applications.

U.S. Pat. No. 4,403,666 describes a drill rig having a drill rig mast and a transfer arm. One or more clamps of the transfer arm are resiliently mounted to the transfer arm so as to provide limited axial movement of the clamps and thereby of a clamped down hole tubular. This resilient support for the down hole tubular serves to reduce damage to threaded ends of the tubular during tubular handling operations. In addition, the clamps of the transfer arm are provided with resilient clamping surfaces which serve to engage the clamped tubular frictionally without gouging or deeply scratching a surface thereof. A pair of automatic, self-centering, hydraulic tongs is provided for making up and breaking out threaded connections of tubulars having various diameters without manual adjustment of the tongs.

SUMMARY OF THE DISCLOSURE

In an aspect of the present disclosure, a pipe loading system for a drilling machine is provided. The pipe loading system includes a stem defining a longitudinal axis. The stem has a first end and a second end disposed opposite to the first end along the longitudinal axis. The pipe loading system includes a first receptacle disposed on the first end of the stem. The first receptacle has a substantially cylindrical configuration defining an opening. The first receptacle is adapted to removably receive a first end of a first pipe through the opening. The pipe loading system includes a guide ring removably disposed on the first receptacle and in association with the opening. The guide ring is adapted to removably receive a first end of a second pipe. The pipe loading system also includes a second receptacle disposed on the stem and spaced apart from the first receptacle along the longitudinal axis. The second receptacle includes a hook portion disposed on the stem. The second receptacle also includes a gate portion disposed in association with the hook portion and defining a first receiving portion. The first receiving portion is adapted to removably receive a second end of the first pipe. The pipe loading system further includes a liner assembly removably disposed on the second receptacle and defining a second receiving portion. The second receiving portion is adapted to removably receive a second end of the second pipe. A diameter of the second pipe is smaller than a diameter of the first pipe.

In another aspect of the present disclosure, a drilling machine is provided. The drilling machine includes a chassis. The drilling machine includes a set of ground engaging members operably coupled to the chassis. The drilling machine also includes a drill mast disposed on the chassis. The drilling machine further includes at least one pipe loading system mounted on the drill mast. The at least one pipe loading system includes a stem operably coupled to the drill mast and defining a longitudinal axis. The stem has a first end and a second end disposed opposite to the first end along the longitudinal axis. The at least one pipe loading system includes a first receptacle disposed on the first end of the stem. The first receptacle has a substantially cylindrical configuration defining an opening. The first receptacle is adapted to removably receive a first end of a first pipe through the opening. The at least one pipe loading system includes a guide ring removably disposed on the first receptacle and in association with the opening. The guide ring is adapted to removably receive a first end of a second pipe. The at least one pipe loading system also includes a second receptacle disposed on the stem and spaced apart from the first receptacle along the longitudinal axis. The second receptacle includes a hook portion disposed on the stem. The second receptacle also includes a gate portion disposed in association with the hook portion and defining a first receiving portion. The first receiving portion is adapted to removably receive a second end of the first pipe. The at least one pipe loading system further includes a liner assembly removably disposed on the second receptacle and defining a second receiving portion. The second receiving portion is adapted to removably receive a second end of the second pipe. A diameter of the second pipe is smaller than a diameter of the first pipe.

In yet another aspect of the present disclosure, a sizing toolkit for a pipe loading system associated with a drilling machine is provided. The pipe loading system has a stem, a first receptacle defining an opening, and a second receptacle defining a first receiving portion. The sizing toolkit includes a guide ring removably disposed on the first receptacle and in association with the opening. A diameter of the guide ring is smaller than a diameter of the opening. The sizing toolkit also includes a liner assembly removably disposed on the second receptacle and defining a second receiving portion. A size of the second receiving portion is smaller than a size of the first receiving portion.

Other features and aspects of this disclosure will be apparent from the following description and the accompanying drawings.

DETAILED DESCRIPTION

Figure 1A:
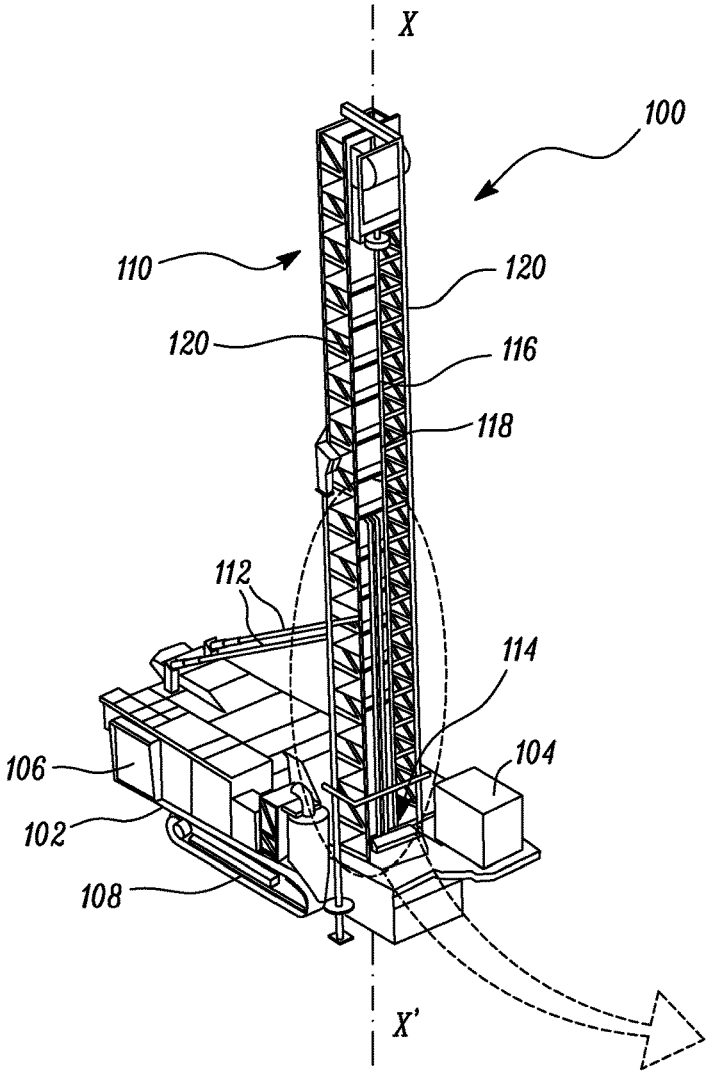
FIG. 1A is a perspective view of an exemplary drilling machine, according to one embodiment of the present disclosure.

Wherever possible, the same reference numbers will be used throughout the drawings to refer to the same or like parts. Referring to FIG. 1A, a perspective view of an exemplary drilling machine 100 is illustrated. The drilling machine 100 will be hereinafter interchangeably referred to as the "machine 100". In the illustrated embodiment, the machine 100 is a rotary blasthole type drilling machine 100. In other embodiments, the machine 100 may be any other drilling machine, such as a surface drilling machine, a boom mounted drilling machine, and so on, based on application requirements. The machine 100 performs various drilling related operations, such as sub-surface mineral extraction; mineral exploration; environmental exploration; hydraulic fracturing; oil, gas, and/or water extraction wells; rock cut drilling for mining and/or quarrying operations; and so on, based on application requirements.

The machine 100 includes a chassis 102. The chassis 102 supports one or more components of the machine 100 thereon. The machine 100 also includes an operator cabin 104 mounted on the chassis 102. The operator cabin 104 may include one or more controls, such as one or more operator consoles, joysticks, pedals, levers, buttons, switches, steering, and so on. The controls are adapted to control an operation of the machine 100 on a work surface (not shown). It should be noted that, in many situations, the machine 100 may be an autonomous machine, a semi-autonomous machine, a remotely operated machine, a remotely supervised machine, and so on, based on application requirements.

The machine 100 also includes an enclosure 106 provided on the chassis 102. The enclosure 106 encloses a power source (not shown) mounted on the chassis 102. The power source provides power to the machine 100 for mobility and operational requirements. The power source may include, but not limited to, a diesel engine, a gasoline engine, a gaseous fuel powered engine, a dual fuel powered engine, an electric motor, a fuel cell, a battery, and/or a combination thereof, based on application requirements. Additionally, the machine 100 may include components and/or systems (not shown), such as a fuel delivery system, an air delivery system, a lubrication system, a propulsion system, a drive-train, a drive control system, a machine control system, and so on, based on application requirements.

The machine 100 also includes a set of ground engaging members 108 (only one ground engaging member shown in the accompanying figure). The ground engaging members 108 are operably coupled to the chassis 102. In the illustrated embodiment, the ground engaging members 108 are tracks. In other embodiments, the ground engaging members 108 may be wheels. The ground engaging members 108 support and provide mobility to the machine 100 on the work surface. As such, the ground engaging members 108 provide movement, turning, positioning, and travel of the machine 100 on the work surface.

Additionally, or optionally, in some embodiments, the ground engaging members 108 may include a number of stabilizer columns (not shown). The stabilizer columns may be selectively deployed in order to engage with the work surface and provide stability to the machine 100 on the work surface. As such, the stabilizer columns may be actuated using any actuation mechanism, such as hydraulic actuators, electric actuators, magnetic actuators, and so on, based on application requirements.

The machine 100 also includes a drill mast 110 disposed on the chassis 102. The drill mast 110 will be hereinafter interchangeably referred to as the "mast 110". The mast 110 is movable relative to the chassis 102 between a substantially vertical position and a non-vertical position via a shift cylinder 112. As such, the shift cylinder 112 provides alignment of the mast 110 along a height and a width of the chassis 102. The mast 110 is a linearly extending structure, and in the accompanying figure, is upright, extending along a vertical axis X-X'. The mast 110 supports one or more drilling components of the machine 100.

The machine 100 also includes a drill assembly 114. The drill assembly 114 is movably disposed on the mast 110. The drill assembly 114 is adapted for drilling holes, channels, tunnels, openings, and so on into, within, and/or extending into, and/or below, the work surface. Accordingly, the drill assembly 114 includes a drill bit (not shown) and a drill string 116 removably coupled to the drill bit. Accordingly, the drill assembly 114 is adapted to drill a borehole (not shown) into the work surface.

The drill string 116 includes one or more columns or pipes 118 interlinked with each other and with the drill bit. Each of the pipes 118 of the drill assembly 114 have a hollow and generally cylindrical configuration. The pipes 118 provide extension of the drill bit into the borehole. For example, each pipe 118 may be coupled to another pipe 118 by way of a threaded connection (not shown). In other embodiments, the pipes 118 may be interlinked with each other by way of other similar connections, for example, by lock fittings, snap fittings, and so on, based on application requirements. The drill string 116 is slidably coupled with the mast 110 via supporting rails 120 and may be driven by a motor (not shown) to slidably move relative to the mast 110 on the supporting rails 120 along the vertical axis X-X'.

Figure 1B:
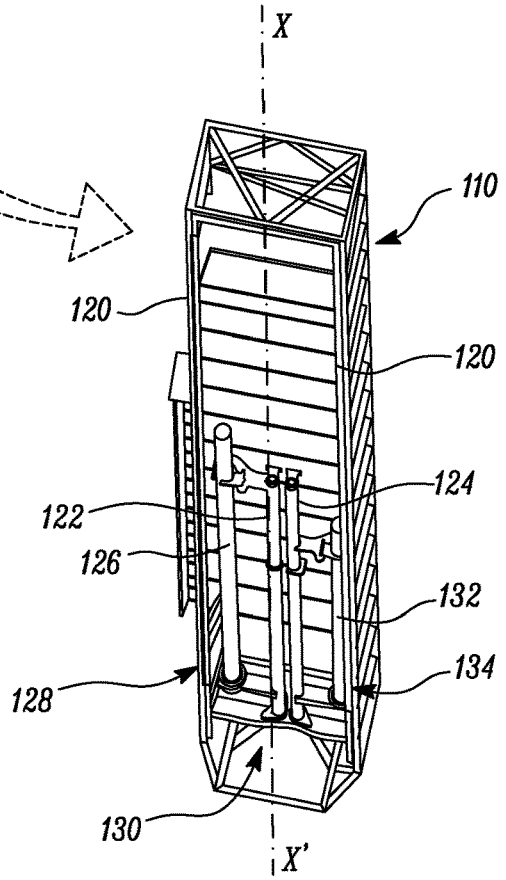
FIG. 1B is a perspective view of a portion of the drilling machine, according to one embodiment of the present disclosure.

The machine 100 also includes a pipe loading system. In the illustrated embodiment, the machine 100 has a dual pipe loader configuration. As such, the pipe loading system includes a plurality of pipe loading systems. Each of the plurality of pipe loading systems is disposed spaced apart from another on the drill mast 110. More specifically, referring to FIG. 1B, the plurality of pipe loading systems includes a first pipe loading system 122 and a second pipe loading system 124. The first pipe loading system 122 will be hereinafter interchangeably referred to as the "first loader 122", and the second pipe loading system 124 will be hereinafter interchangeably referred to as the "second loader 124". Each of the first loader 122 and the second loader 124 is rotatably mounted on the drill mast 110. Also, each of the first loader 122 and the second loader 124 is disposed adjacent one another and substantially parallel to the vertical axis X-X'. In other embodiments, the machine 100 may include single or multiple pipe loading systems rotatably mounted on the drill mast 110, based on application requirements.

The first loader 122 is adapted to removably receive a first pipe 126 and lock the first pipe 126 relative to the first loader 122 during make-up and/or break-out of the drill string 116. Further, based on rotation of the first loader 122, the first pipe 126 is moved from a side region 128 of the drill mast 110 to a central region 130 of the drill mast 110 for coupling the first pipe 126 with the motor of the drill assembly 114. Also, the second loader 124 is adapted to removably receive another pipe 132. Further, based on rotation of the second loader 124, the another pipe 132 is moved from a side region 134 of the drill mast 110 to the central region 130 of the drill mast 110 for coupling the another pipe 132 with the motor of the drill assembly 114.

Figure 2:
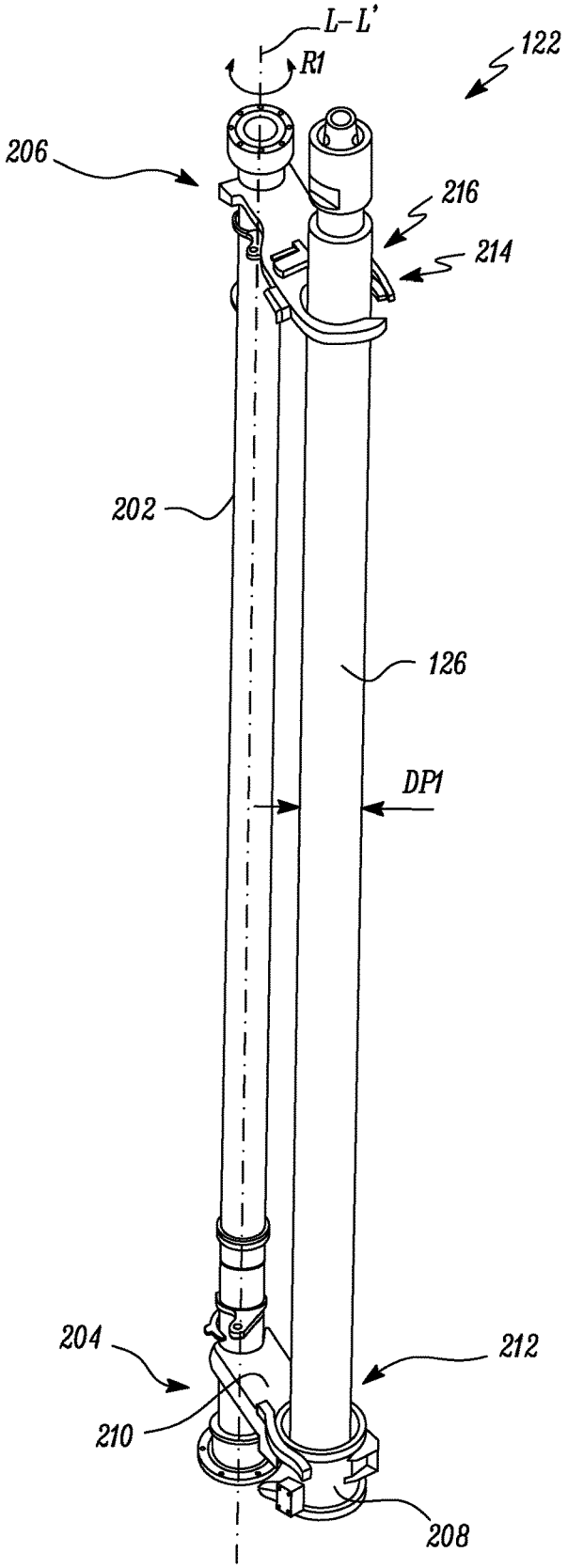
FIG. 2 is a perspective view of a pipe loading system of the drilling machine, according to one embodiment of the present disclosure.

Referring to FIG. 2, the pipe loading system will now be explained with reference to the first loader 122. The first loader 122 includes a stem 202. The stem 202 defines a longitudinal axis L-L'. The stem 202 includes a first end 204 and a second end 206. The second end 206 is disposed opposite to the first end 204 along the longitudinal axis L-L'. The stem 202 is operably coupled to the drill mast 110. More specifically, the stem 202 is operably coupled to the drill mast 110 using one or more coupling elements (not shown), such as bearings, washers, bushes, collars, fasteners, and so on. The coupling elements may be disposed on the first end 204 and/or the second end 206 of the stem 202. As such, the stem 202 is adapted to rotate about the longitudinal axis L-L' relative to the drill mast 110 in a direction "R1".

The first loader 122 also includes a first receptacle 208. The first receptacle 208 is disposed on the first end 204 of the stem 202 via an arm 210. The first receptacle 208 is adapted to removably receive a first end 212 of the first pipe 126. The first loader 122 also includes a second receptacle 214. The second receptacle 214 is disposed on the stem 202 and spaced apart from the first receptacle 208 along the longitudinal axis L-L'. In the illustrated embodiment, the second receptacle 214 is disposed on the second end 206 of the stem 202. In other embodiments, the second receptacle 214 may be disposed at any location on the stem 202 between the first end 204 and the second end 206. The second receptacle 214 is adapted to removably receive a second end 216 of the first pipe 126. In the illustrated embodiment, the first pipe 126 has a constant diameter, such that each of the first end 212 and the second end 216 defines a diameter "DP1". In other embodiments, the first pipe 126 may have a varying diameter, such that each of the first end 212 and the second end 216 may have different diameters.

Figure 3:
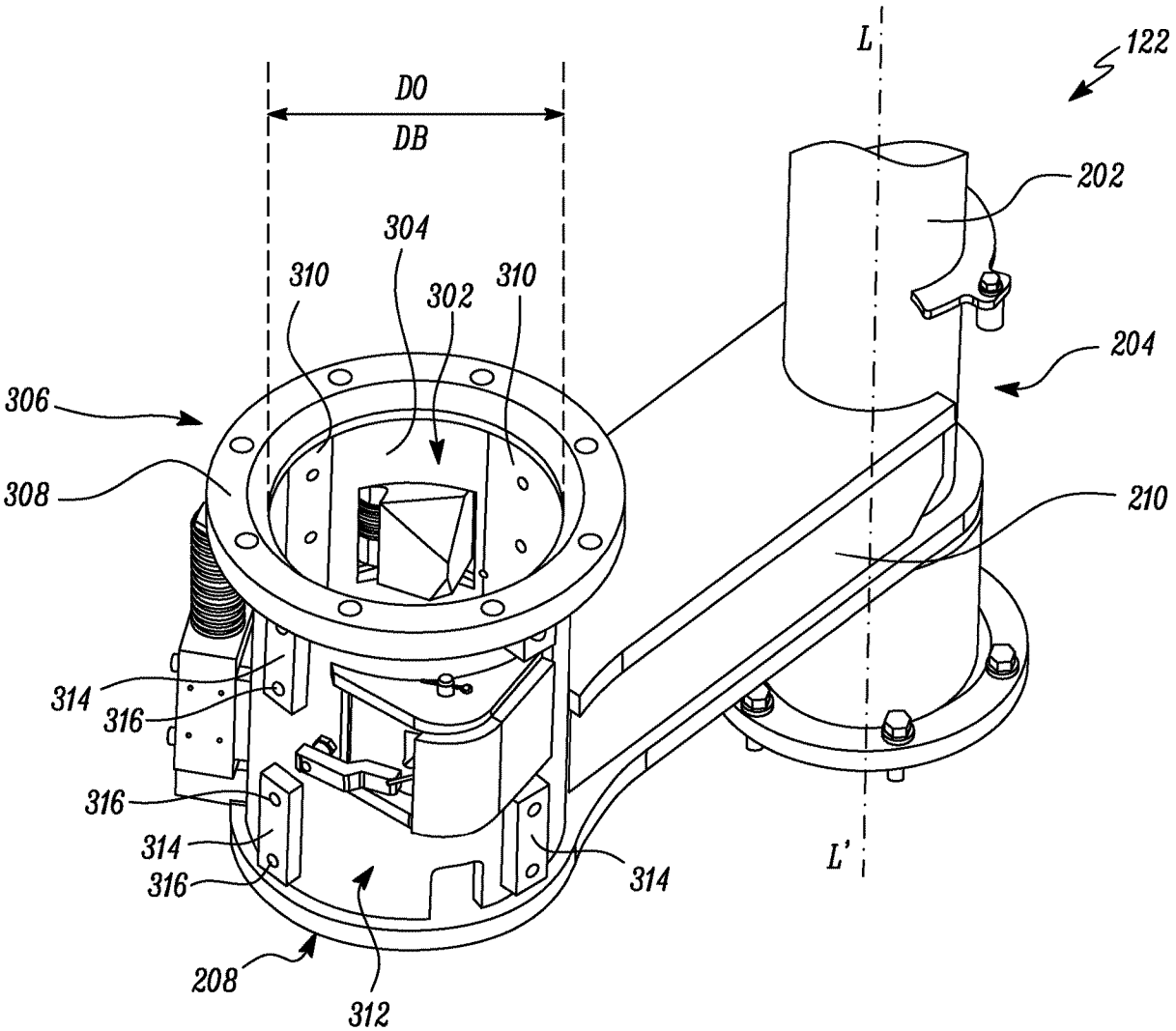
FIG. 3 is a perspective view of a portion of the pipe loading system, according to one embodiment of the present disclosure.

Referring to FIG. 3, the first receptacle 208 has a substantially hollow and cylindrical configuration, having an inner surface 304 and defining an opening 302. In the illustrated embodiment, the first receptacle 208 has a substantially circular configuration. Accordingly, each of the opening 302 and the inner surface 304 defines a diameter "DO". In other embodiments, the first receptacle 208 may have any other configuration, such as a rectangular configuration, a triangular configuration, and so on, based on application requirements. The first receptacle 208 is adapted to removably receive the first end 212 of the first pipe 126 through the opening 302.

The first loader 122 also includes a sizing toolkit 306. The sizing toolkit 306 will be hereinafter interchangeably referred to as the "toolkit 306". The toolkit 306 includes a base ring 308. The base ring 308 defines a diameter "DB". The base ring 308 is disposed on the first receptacle 208 and adjacent to the opening 302. The diameter "DB" of the base ring 308 is approximately equal to the diameter "DO" of the opening 302 and slightly larger than the diameter "DP1" of the first end 212 of the first pipe 126. Accordingly, the base ring 308 is adapted to contact with the first end 212 of the first pipe 126.

More specifically, the base ring 308 is adapted to guide the first end 212 of the first pipe 126 into the opening 302. In other embodiments, such as in an inclined position of the mast 110 or the first loader 122 during tramming or inclined drilling, the base ring 308 is adapted to support the first end 212 of the first pipe 126 in the opening 302. In some embodiments, the base ring 308 may be coupled to the first receptacle 208 adjacent to the opening 302 using any coupling method, such as welding, screws, rivets, pins, clamps, and so on, after manufacturing of the first receptacle 208. In some embodiments, the base ring 308 may be integrally formed on the first receptacle 208 adjacent to the opening 302 during manufacturing of the first receptacle 208.

Figure 4:
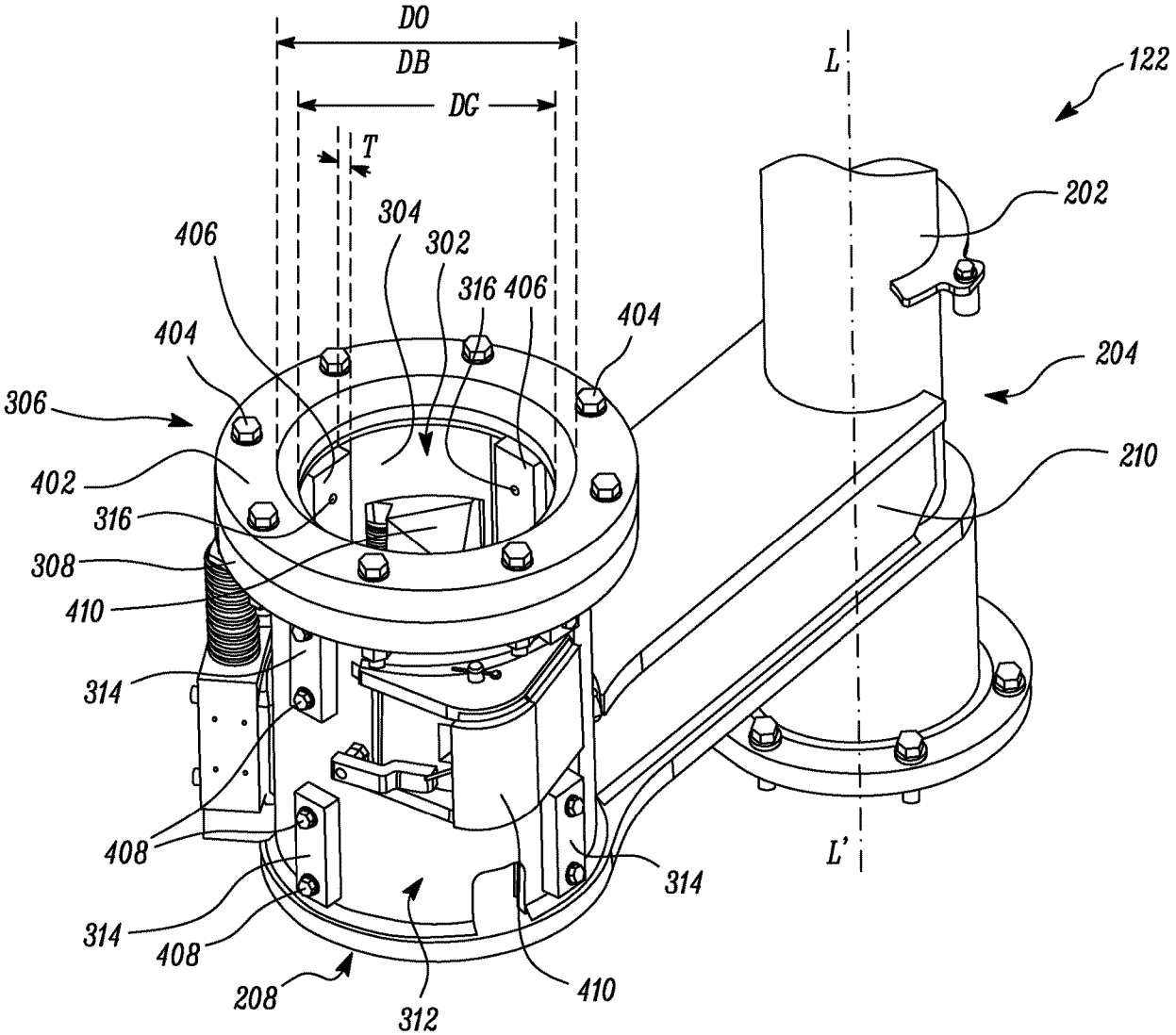
FIG. 4 is another perspective view of the portion of the pipe loading system of FIG. 3, according to one embodiment of the present disclosure.

Referring to FIG. 4, the toolkit 306 also includes a guide ring 402. The guide ring 402 defines a diameter "DG". The guide ring 402 is disposed on the first receptacle 208 and in association with the opening 302 of the first receptacle 208. More specifically, in the illustrated embodiment, the guide ring 402 is removably coupled to the base ring 308 using one or more fasteners 404. Accordingly, the base ring 308 is adapted to removably receive the guide ring 402 on the first receptacle 208. In the illustrated embodiment, the fasteners 404 are nuts and bolts. In other embodiments, one or more of the fasteners 404 may be any other fastening elements, such as screws, clamps, pins, and so on. In some embodiments, the guide ring 402 may be welded to the base ring 308.

Figure 5:
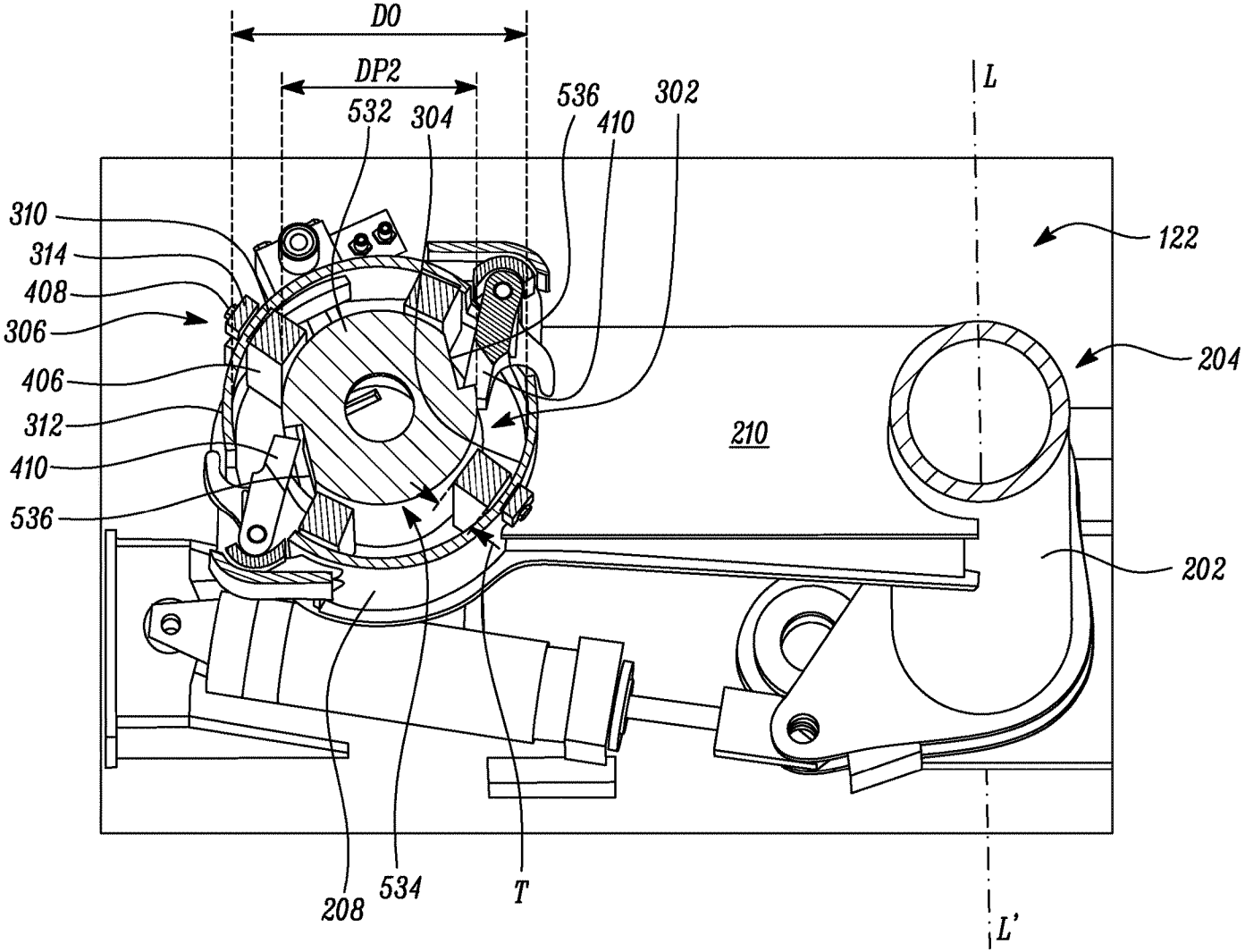
FIG. 5 is yet another perspective cutaway view of the portion of the pipe loading system of FIG. 3, according to one embodiment of the present disclosure.

In some embodiments, the guide ring 402 may be removably disposed directly on the first receptacle 208 adjacent to the opening 302. In such a situation, the base ring 308 may be omitted. The diameter "DG" of the guide ring 402 is smaller than the diameter "DO" of the opening 302, the diameter "DB" of the base ring 308, and the diameter "DP1" of the first end 212 of the first pipe 126. Further, the diameter "DG" of the guide ring 402 is slightly larger than a diameter "DP2" of a first end 534 of a second pipe 532 (see FIG. 5), such that the diameter "DP2" of the first end 534 of the second pipe 532 is smaller than the diameter "DP1" of the first end 212 of the first pipe 126.

Accordingly, the guide ring 402 is adapted to contact and removably receive the first end 534 of the second pipe 532. More specifically, the guide ring 402 is adapted to guide the first end 534 of the second pipe 532 into the opening 302. In other embodiments, such as in an inclined position of the mast 110 or the first loader 122 during tramming or inclined drilling, the guide ring 402 is adapted to support the first end 534 of the second pipe 532 in the opening 302. Additionally, the guide ring 402 may be provided with one or more suitable structural/dimensional features, such as a chamfer, a bevel, a fillet, and so on in order to provide improved entry of the first end 534 of the second pipe 532 into the first receptacle 208.

The toolkit 306 also includes a guide strip 406. The guide strip 406 is removably disposed within the first receptacle 208. More specifically, in the illustrated embodiment, the toolkit 306 includes a plurality of guide strips 406. In the illustrated embodiment, the first receptacle 208 includes four guide strips 406 (only two guide strips shown in the accompanying figure). In other embodiments, the first receptacle 208 may include single or multiple guide strips 406, based on application requirements. Each of the guide strips 406 is disposed spaced apart from one another on the inner surface 304 within the first receptacle 208. Each of the guide strips 406 is removably coupled to the first receptacle 208 using one or more fasteners 408, such as screws, bolts, pins, and so on. In some embodiments, each of the guide strips 406 may be welded to the first receptacle 208.

Each of the guide strips 406 defines a thickness "T". The thickness "T" of each of the guide strips 406 is approximately equal to half of difference between the diameter "DO" of the opening 302 and the diameter "DG" of the guide ring 402. As such, each of the guide strips 406 is adapted to contact the first end 534 of the second pipe 532 received within the first receptacle 208. Accordingly, each of the guide strips 406 is adapted to limit clearance between the inner surface 304 of the first receptacle 208 and the first end 534 of the second pipe 532 and, thus, movement of the first end 534 of the second pipe 532 within the first receptacle 208. More specifically, each of the guide strips 406 is adapted to guide the first end 534 of the second pipe 532 into the opening 302. In other embodiments, such as in an inclined position of the mast 110 or the first loader 122 during tramming or inclined drilling, each of the guide strips 406 is adapted to support and guide the first end 534 of the second pipe 532 in the opening 302.

In the illustrated embodiment of FIG. 4, the guide ring 402 has a substantially annular configuration. In some embodiments, the guide ring (not shown) may have a substantially elongated configuration, such as a cylindrical configuration. In such a situation, the guide ring may be disposed on the base ring 308 and may extend into the opening 302 of the first receptacle 208 away from the base ring 308. More specifically, the guide ring may extend into the opening 302 adjacent to the inner surface 304 of the first receptacle 208. Accordingly, in such a situation, each of the guide strips 406 may be omitted.

Additionally, the toolkit 306 includes one or more pawls 410. The pawls 410 are disposed on the first receptacle 208 and in association with the opening 302. More specifically, the pawls 410 are disposed on an outer surface 312 of the first receptacle 208 and extend into the opening 302 of the first receptacle 208 through the inner surface 304. In the illustrated embodiment, the first receptacle 208 includes two pawls. In other embodiments, the first receptacle 208 may include single or multiple pawls, based on application requirements. The pawls 410 may be movably coupled to the first receptacle 208 using any actuation mechanism, such as a spring-loaded mechanism, a fluid-based actuator, an electric actuator, and so on. The pawls 410 are adapted to engage with a flattened portion 536 (see FIG. 5) disposed on the first end 534 of the second pipe 532 and/or the first end 212 of the first pipe 126. As such, the pawls 410 are adapted to limit rotation of the second pipe 532 or the first pipe 126 relative to the first receptacle 208 during application of make-up and/or break-out torque by the motor of the drill assembly 114.

Referring back to FIG. 3, in some embodiments, the first receptacle 208 may include a base strip 310. The base strip 310 is disposed on the inner surface 304 of the first receptacle 208 and in association with each of the guide strips 406. More specifically, the base strip 310 is aligned relative to each of the guide strips 406 and adapted to be disposed between the inner surface 304 of the first receptacle 208 and each of the guide strips 406. The base strip 310 may be coupled on the inner surface 304 of the first receptacle 208 using any coupling method, such as welding. The base strip 310 is adapted to provide an improved contact of each of the guide strips 406 with the inner surface 304 and limit damage to the inner surface 304 by each of the guide strips 406 due to excessive torqueing of the fasteners 408. Additionally, the base strip 310 provides an efficient and effective clamping of each of the guide strips 406 relative to the first receptacle 208.

The toolkit 306 also includes a reinforcing strip 314 disposed on the first receptacle 208 and in association with the guide strip 406. The reinforcing strip 314 is disposed on the outer surface 312 of the first receptacle 208 and aligned relative to each of the guide strips 406. The reinforcing strip 314 may be coupled on the outer surface 312 of the first receptacle 208 using any coupling method, such as welding. During assembly of each of the guide strips 406, each of the fasteners 408 is disposed in holes 316 provided through each of the reinforcing strip 314, the base strip 310, and the guide strip 406 in order to couple the respective guide strip 406 on the inner surface 304 of the first receptacle 208. As such, the reinforcing strip 314 is adapted to provide a reinforced surface on the outer surface 312 aligned with the respective guide strip 406, an improved clamping of each of the fasteners 408 with the first receptacle 208, and limit damage to the first receptacle 208 due to excessive torqueing of the fasteners 408.

Figure 6:
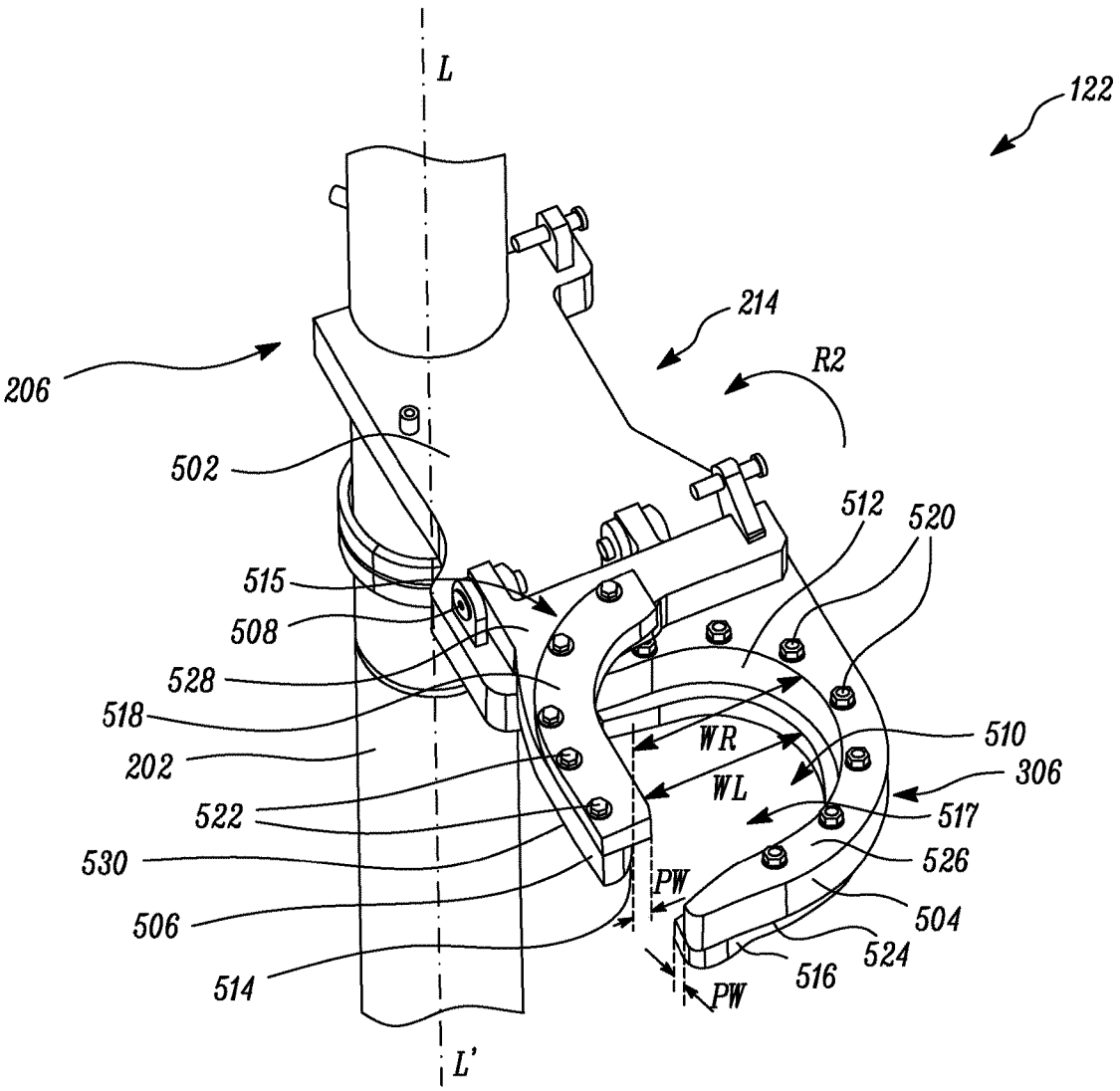
FIG. 6 is a perspective view of another portion of the pipe loading system, according to one embodiment of the present disclosure.

Referring to FIG. 6, the second receptacle 214 includes a mounting plate 502. The mounting plate 502 will be hereinafter interchangeably referred to as the "plate 502". The plate 502 is disposed on the stem 202. Also, the plate 502 extends away from the stem 202 substantially perpendicular to the longitudinal axis L-L'. In the illustrated embodiment, the plate 502 has a substantially flat configuration. In other embodiments, the plate 502 may have any other configuration, such as a stepped configuration, an angled configuration, and so on, based on application requirements.

In the illustrated embodiment, the plate 502 is fixedly coupled to the stem 202, such as by welding. In other embodiments, the plate 502 may be removably coupled to the stem 202, such as by using one or more fasteners (not shown). The second receptacle 214 also includes a hook portion 504. The hook portion 504 will be hereinafter interchangeably referred to as the "hook 504". The hook 504 extends from the plate 502 substantially perpendicular to the longitudinal axis L-L'. In the illustrated embodiment, the hook 504 has a substantially curved configuration. In other embodiments, the hook 504 may have any other configuration, such as an angled configuration, based on application requirements.

The second receptacle 214 further includes a gate portion 506. The gate portion 506 will be hereinafter interchangeably referred to as the "gate 506". In the illustrated embodiment, the gate 506 has a substantially L-shaped configuration. In other embodiments, the gate 506 may have any other configuration, such as a curved configuration, an angled configuration, and so on, based on application requirements. The gate 506 is disposed in association with the hook 504 and movably coupled to the plate 502 via one or more hinge joints 508. As such, the gate 506 is adapted to move in an engaged position (as shown in the accompanying figure), and a disengaged position (not shown) based on rotation of the gate 506 about the hinge joints 508 in a direction "R2".

The gate 506 is adapted to move between the engaged position and the disengaged position using any actuator (not shown), such as fluid-based actuator, an electric actuator, a magnetic actuator, and so on, based on application requirements. Accordingly, in the engaged position, the gate 506 defines a first receiving portion 510 in association with the hook 504. More specifically, the first receiving portion 510 is defined by an inner surface 512 of the hook 504 and an inner surface 514 of the gate 506. The first receiving portion 510 defines a width "WR" between the inner surface 512 of the hook 504 and the inner surface 514 of the gate 506. The width "WR" of the first receiving portion 510 is approximately equal to the diameter "DP1" of the second end 216 of the first pipe 126. Accordingly, the first receiving portion 510 is adapted to contact and removably receive the second end 216 of the first pipe 126. Further, in the disengaged position of the gate 506, the second end 216 of the first pipe 126 is adapted to be released from the first receiving portion 510.

The toolkit 306 also includes a liner assembly 515. The liner assembly 515 is removably disposed on the second receptacle 214 and defines a second receiving portion 517. The liner assembly 515 is removably disposed on one of the hook portion 504 and the gate portion 506 of the second receptacle 214. More specifically, the toolkit 306 includes a hook liner 516 and a gate liner 518. The hook liner 516 is removably disposed on the hook 504 of the second receptacle 214. The gate liner 518 is removably disposed on the gate 506 of the second receptacle 214. In the illustrated embodiment, the hook liner 516 is removably coupled to the hook 504 using a number of fasteners 520, such as nuts and bolts. Also, the gate liner 518 is removably coupled to the gate 506 using a number of fasteners 522, such as nuts and bolts. In other embodiments, each of the hook liner 516 and the gate liner 518 may be removably coupled to the hook 504 and the gate 506, respectively, using any other fastening elements, such as screws, pins, clamps, and so on, based on application requirements. In other embodiments, each of the hook liner 516 and the gate liner 518 may be welded to the hook 504 and the gate 506, respectively.

The liner assembly 515 is disposed in association with the first receiving portion 510 of the second receptacle 214. More specifically, the hook liner 516 is disposed on the hook 504 and adjacent to the first receiving portion 510 of the second receptacle 214. Also, the gate liner 518 is disposed on the gate 506 and adjacent to the first receiving portion 510 of the second receptacle 214. In the illustrated embodiment, the hook liner 516 is removably disposed on a bottom surface 524 of the hook 504. In other embodiments, the hook liner 516 may be alternatively disposed on a top surface 526 or the inner surface 512 of the hook 504, based on application requirements. Also, in the illustrated embodiment, the gate liner 518 is removably disposed on a top surface 528 of the gate 506. In other embodiments, the gate liner 518 may be alternatively disposed on a bottom surface 530 or the inner surface 514 of the gate 506, based on application requirements.

The second receiving portion 517 is adapted to contact and removably receive a second end (not shown) of the second pipe 532. More specifically, each of the hook liner 516 and the gate liner 518 extend inward relative to the inner surfaces 512, 514 of each of the hook 504 and the gate 506, respectively. As such, each of the hook liner 516 and the gate liner 518 define a protruding width "μW". Each of the hook liner 516 and the gate liner 518 is adapted to reduce the width "WR" of the first receiving portion 510 to an effective width "WL" of the second receiving portion 517. As such, a size of the second receiving portion 517 is smaller than a size of the first receiving portion 510. In some situations, the effective width "WL" may be referred to as an effective diameter, based on an overall configuration of the second receiving portion 517. Accordingly, each of the hook liner 516 and the gate liner 518 is adapted to contact with the second end of the second pipe 532, such that a diameter of the second end of the second pipe 532 is smaller than the width "WR" of the first receiving portion 510 and approximately equal to the effective width "WL" of the second receiving portion 517.

Figure 7:
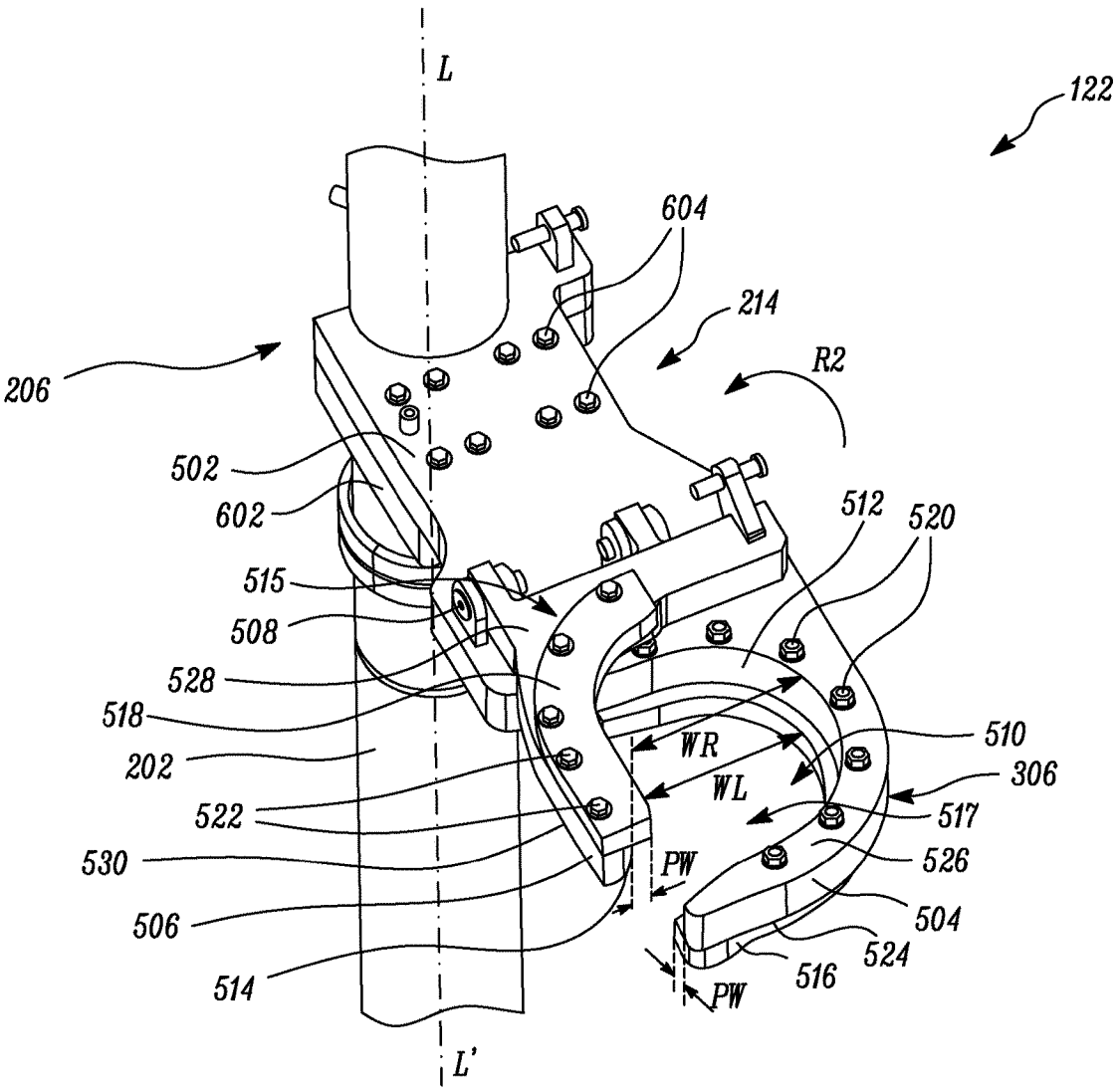
FIG. 7 is another perspective view of the portion of the pipe loading system of FIG. 6, according to one embodiment of the present disclosure.
Figure 8:
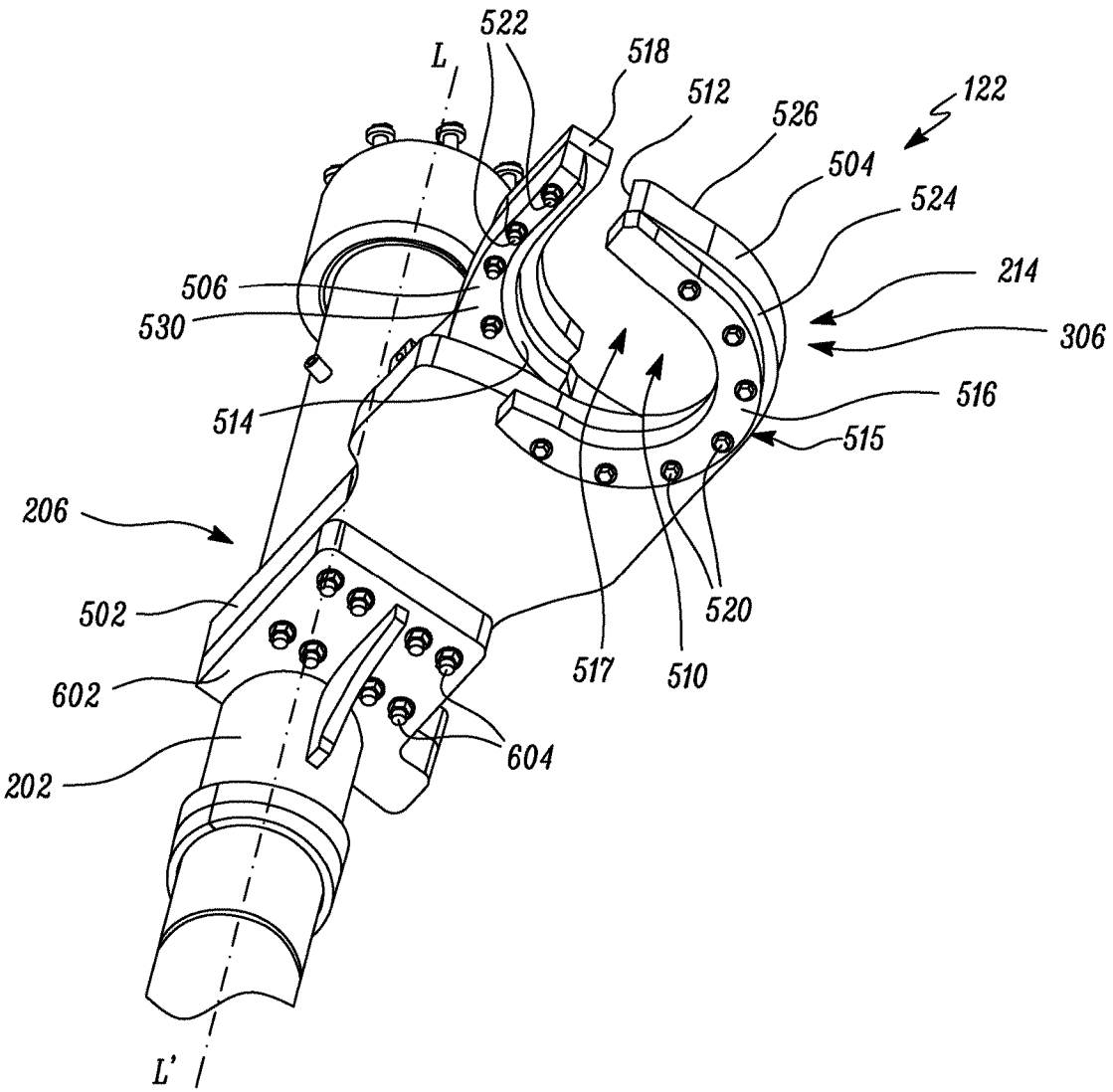
FIG. 8 is yet another perspective view of the portion of the pipe loading system of FIG. 7, according to one embodiment of the present disclosure.

Referring to FIGS. 7 and 8, in some embodiments, the toolkit 306 further includes a mounting bracket 602 disposed on the stem 202. More specifically, in the illustrated embodiment, the toolkit 306 includes a plurality of mounting brackets 602 (only one mounting bracket shown in the accompanying figures). Each of the plurality of mounting brackets 602 is disposed spaced apart from another on the stem 202 along the longitudinal axis L-L'. The mounting bracket 602 is adapted to removably receive the second receptacle 214 on the stem 202. As such, the plate 502 of the second receptacle 214 may be removably coupled to the mounting bracket 602 using one or more fasteners 604. In the illustrated embodiments, the fasteners 604 are nuts and bolts. In other embodiments, the plate 502 of the second receptacle 214 may be removably coupled to the mounting bracket 602 using any other fastening elements, such as screws, clamps, pins, and so on.

More specifically, each of the mounting brackets 602 may be provided at varying distances on the stem 202 between the first end 204 and the second end 206 along the longitudinal axis L-L'. As such, based on a length of a pipe to be handled, the second receptacle 214 may be disposed on a suitable mounting bracket 602. For example, during handling of a relatively shorter length of a pipe, the second receptacle 214 may be removably coupled to a mounting bracket (not shown) disposed relatively closer to the first receptacle 208 on the stem 202. In another situation, during handling of a relatively longer length of a pipe, the second receptacle 214 may be removably coupled to the mounting bracket 602 disposed relatively farther from the first receptacle 208, such as on the second end 206 of the stem 202.

The toolkit 306 including each of the base ring 308, the guide ring 402, the guide strips 406, the base strips 310, the reinforcing strips 314, the hook liner 516, the gate liner 518, and the mounting bracket 602 may be manufactured using any material, such as metal, alloy, polymer, rubber, a combination thereof, and so on, based on application requirements. Also, each of the base ring 308, the guide ring 402, the guide strips 406, the base strips 310, the reinforcing strips 314, the hook liner 516, the gate liner 518, and the mounting bracket 602 may be manufactured using any process, such as casting, forging, fabrication, additive manufacturing, and so on, based on application requirements.

INDUSTRIAL APPLICABILITY

The present disclosure relates to the toolkit 306 for the pipe loading system, such as the first loader 122, of the machine 100. The toolkit 306 provides changing an effective size of the first loader 122, such that the first loader 122 may be adapted to handle the first pipe 126 having the diameter "DP1" and the second pipe 532 having the diameter "DP2" smaller than the diameter "DP1". For example, the first loader 122 may be adapted to handle the first pipe 126 having the diameter "DP1" equal to approximately 13 inches (in.). In such a situation, the diameter "DB" of the base ring 308 and the diameter "DO" of the opening 302 of the first receptacle 208 may be slightly larger than or approximately equal to 13 in. Also, the guide strips 406 within the first receptacle 208 may be omitted and the pawls 410 adapted to engage with a pipe of approximately equal to 13 in. may be disposed on the first receptacle 208. Further, the width "WR" of the first receiving portion 510 of the second receptacle 214 may also be equal to approximately 13 in.

In a situation when the second pipe 532 having the diameter "DP2" equal to approximately 10 in. may have to be handled by the first loader 122, the toolkit 306 may be bolted on each of the first receptacle 208 and the second receptacle 214. More specifically, the guide ring 402 having the diameter "DG" slightly larger than or approximately equal to 10 in. may be mounted on the base ring 308, the guide strips 406 having the thickness "T" of approximately 1.5 in. radially may be mounted within the first receptacle 208, and the pawls 410 adapted to engage with a pipe of approximately equal to 10 in. may be disposed on the first receptacle 208 in order to reduce an effective diameter of the first receptacle 208 to approximately 10 in. Accordingly, the first receptacle 208 may now receive the first end 534 of the second pipe 532.

Also, the hook liner 516 and the gate liner 518 each having the protruding width "PW" of approximately 1.5 in. may be mounted on the hook 504 and the gate 506, respectively, in order to reduce the effective width "WL" of the second receiving portion 517 to approximately 10 in. As such, the second receptacle 214 may now receive the second end of the second pipe 532. Accordingly, in other situations, the first receptacle 208 and the second receptacle 214 may be adapted to receive the second pipe 532 having any diameter smaller than 13 in. by using appropriate sizes of each of the guide ring 402, the guide strips 406, the pawls 410, the hook liner 516, and the gate liner 518.

The toolkit 306 also provides changing an effective size of the first loader 122, such that the first loader 122 may be adapted to handle the first pipe 126 having a length longer than a length of the second pipe 532. For example, the first loader 122 may be adapted to handle the first pipe 126 having the length equal to approximately 40 feet (ft.). In such a situation, the mounting bracket 602 and the second receptacle 214 may be disposed on the second end 206 of the stem 202, such that the second receptacle 214 may receive the second end 216 of the first pipe 126.

In a situation when the second pipe 532 may have the length of approximately 20 ft., the second receptacle 214 may be disassembled from the mounting bracket 602 and may be assembled on another mounting bracket (not shown) provided approximately at a middle region of the stem 202 between the first end 204 and the second end 206. As such, an effective distance between the first receptacle 208 and the second receptacle 214 along the longitudinal axis L-L' may be reduced, such that the second receptacle 214 may receive the second end of the second pipe 532 having the length of approximately 20 ft. Accordingly, in other situations, the first receptacle 208 and the second receptacle 214 may be adapted to receive the second pipe 532 having any length smaller than 40 in. by mounting the second receptacle 214 on an appropriate mounting bracket disposed on the stem 202 between the first end 204 and the second end 206.

The toolkit 306 provides a simple, effective, and cost-efficient method to employ the first loader 122 for differently sized pipes in diameter and/or length. For example, the toolkit 306 having an appropriate size matching a size of the drill pipe to be handled may be simply bolted on the first loader 122 prior to handling the respective pipe. As such, complete replacement of the first loader 122 with another loader adapted to handle a differently sized pipe of diameter and/or lengths may not be required. Accordingly, the first loader 122 may be designed to handle a largest possible diameter of the pipe and may be further easily adapted to handle a smaller diameter pipe by using the bolt-on toolkit 306, in turn, reducing costs, reducing machine downtime, improving productivity, improving flexibility, improving versatility, improving usability, improving customizability, and so on.

It should be noted that although the pipe loading system is described herein with reference to the first loader 122, the second loader 124 has a configuration, orientation, structure, construction, operation, and so on substantially similar to that of the first loader 122. In some embodiments, the second loader 124 may be adapted to receive the another pipe 132 having a length and/or a diameter different from that of the first pipe 126. In such a situation, a distance between a first receptacle of the second loader 124 and a second receptacle of the second loader 124 may be suitably modified in order to removably receive the another pipe 132 in the second loader 124. It should also be noted that although the sizing toolkit 306 is described herein with reference to the first loader 122, in other embodiments, the sizing toolkit 306 may be assembled on the second loader 124 in a manner substantially similar to that described with reference to the first loader 122.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof.

What is claimed is:

1. A pipe loading system for a drilling machine, the pipe loading system comprising:

a stem defining a longitudinal axis, the stem having a first end and a second end disposed opposite to the first end along the longitudinal axis;

a first receptacle disposed on the first end of the stem, the first receptacle having a substantially cylindrical configuration defining an opening, the first receptacle adapted to removably receive a first end of a first pipe through the opening;

a base ring disposed on the first receptacle and adjacent to the opening, the base ring having an inner diameter that is approximately equal to a diameter of the opening and adapted to guide the first end of the first pipe into the opening;

a toolkit disposed on the first receptacle, the first receptacle being configured to removably receive a first end of a second pipe when the toolkit is disposed on the first receptacle, the toolkit including:

a guide ring removably disposed on top of the base ring so as to abut the base ring and in association with the opening, the guide ring adapted to removably receive the first end of the second pipe, an inner diameter of the guide ring being smaller than the inner diameter of the base ring, a plurality of guide strips removably disposed on an inner surface of the first receptacle, a thickness of each guide strip being approximately half of a difference between the inner diameter of the guide ring and the inner diameter of the opening, the plurality of guide strips being configured to contact the first end of the second pipe received in the first receptacle, and a pawl disposed on an outer surface of the first receptacle and extending into the opening of the first receptacle through the inner surface of the first receptacle, the pawl being movably coupled to the first receptacle and adapted to engage with a flattened portion on at least one of the first end of the first pipe and the first end of the second pipe;

a second receptacle disposed on the stem and spaced apart from the first receptacle along the longitudinal axis, the second receptacle including;

a hook portion disposed on the stem; and a gate portion disposed in association with the hook portion and defining a first receiving portion, the first receiving portion adapted to removably receive a second end of the first pipe; and a liner assembly removably disposed on the second receptacle and defining a second receiving portion, the liner assembly including a hook liner removably disposed on the hook portion and a gate liner removably disposed on the gate portion, the hook liner and the gate liner being adjacent to the first receiving portion, the second receiving portion adapted to removably receive a second end of the second pipe, a size of the second receiving portion being smaller than a size of the first receiving portion, wherein a diameter of the second pipe is smaller than a diameter of the first pipe, wherein the pipe loading system is configured to receive the first pipe in a first configuration of the pipe loading system in which the guide ring, the plurality of guide strips, and the liner assembly are removed from the pipe loading system, and wherein the pipe loading system is configured to receive the second pipe in a second configuration of the pipe loading system in which the guide ring, the plurality of guide strips, and the liner assembly are disposed on the pipe loading system.

2. The pipe loading system of claim 1, further comprising a reinforcing strip disposed on the outer surface of the first receptacle and aligned with one guide strip of the plurality of guide strips.

3. The pipe loading system of claim 1, further comprising at least one mounting bracket disposed on the stem, the at least one mounting bracket adapted to removably receive the second receptacle on the stem.

4. The pipe loading system of claim 1, wherein the second receptacle includes a mounting plate disposed on the stem, the hook portion extending from the mounting plate substantially perpendicular to the longitudinal axis, and the gate portion being movably coupled to the mounting plate via a hinge joint between an engaged position and a disengaged position.

5. A drilling machine comprising:

a chassis;

a set of ground engaging members operably coupled to the chassis;

a drill mast disposed on the chassis; and at least one pipe loading system mounted on the drill mast, the at least one pipe loading system including:

a stem operably coupled to the drill mast and defining a longitudinal axis, the stem having a first end and a second end disposed opposite to the first end along the longitudinal axis;

a first receptacle disposed on the first end of the stem, the first receptacle having a substantially cylindrical configuration defining an opening, the first receptacle adapted to removably receive a first end of a first pipe through the opening;

a base ring disposed on the first receptacle and adjacent to the opening, the base ring having an inner diameter that is approximately equal to a diameter of the opening and adapted to guide the first end of the first pipe into the opening;

a toolkit disposed on the first receptacle, the first receptacle being configured to removably receive a first end of a second pipe when the toolkit is disposed on the first receptacle, the toolkit including:

a guide ring removably disposed on top of the base ring so as to abut the base ring and in association with the opening, the guide ring adapted to removably receive the first end of the second pipe, an inner diameter of the guide ring being smaller than the inner diameter of the base ring, a plurality of guide strips removably disposed on an inner surface of the first receptacle, a thickness of each guide strip being approximately half of a difference between the inner diameter of the guide ring and the inner diameter of the opening, the plurality of guide strips being configured to contact the first end of the second pipe received in the first receptacle, and a pawl disposed on an outer surface of the first receptacle and extending into the opening of the first receptacle through the inner surface of the first receptacle, the pawl being movably coupled to the first receptacle and adapted to engage with a flattened portion on at least one of the first end of the first pipe and the first end of the second pipe;

a second receptacle disposed on the stem and spaced apart from the first receptacle along the longitudinal axis, the second receptacle including:

a hook portion disposed on the stem; and a gate portion disposed in association with the hook portion and defining a first receiving portion, the first receiving portion adapted to removably receive a second end of the first pipe; and a liner assembly removably disposed on the second receptacle and defining a second receiving portion, the liner assembly including a hook liner removably disposed on the hook portion and a gate liner removably disposed on the gate portion, the hook liner and the gate liner being adjacent to the first receiving portion, the second receiving portion adapted to removably receive a second end of the second pipe, a size of the second receiving portion being smaller than a size of the first receiving portion, wherein a diameter of the second pipe is smaller than a diameter of the first pipe, wherein the at least one pipe loading system is configured to receive the first pipe in a first configuration of the at least one pipe loading system in which the guide ring, the plurality of guide strips, and the liner assembly are removed from the at least one pipe loading system, and wherein the at least one pipe loading system is configured to receive the second pipe in a second configuration of the at least one pipe loading system in which the guide ring, the plurality of guide strips, and the liner assembly are disposed on the at least one pipe loading system.

6. The drilling machine of claim 5, further comprising at least one mounting bracket disposed on the stem, the at least one mounting bracket adapted to removably receive the second receptacle on the stem.

7. A sizing toolkit for a pipe loading system associated with a drilling machine, the pipe loading system having a stem, a first receptacle having a substantially cylindrical configuration defining an opening, and a second receptacle including a hook portion disposed on the stem and a gate portion disposed in association with the hook portion and defining a first receiving portion, the sizing toolkit comprising:

a base ring disposed on the first receptacle and adjacent to the opening, the base ring having an inner diameter that is approximately equal to a diameter the opening and adapted to guide the first end of the first pipe into the opening;

a guide ring removably disposed on top of the base ring so as to abut the base ring and in association with the opening, an inner diameter of the guide ring being smaller than the inner diameter of the base ring;

a plurality of guide strips removably disposed on an inner surface of the first receptacle, a thickness of each guide strip being approximately half of a difference between the inner diameter of the guide ring and the inner diameter of the opening;

a pawl disposed on an outer surface of the first receptacle and extending into the opening of the first receptacle through the inner surface of the first receptacle, the pawl being movably coupled to the first receptacle; and a liner assembly removably disposed on the second receptacle and defining a second receiving portion, the liner assembly including a hook liner removably disposed on the hook portion and a gate liner removably disposed on the gate portion, the hook liner and the gate liner being adjacent to the first receiving portion, a size of the second receiving portion being smaller than a size of the first receiving portion.

8. The sizing toolkit of claim 7, further comprising a reinforcing strip disposed on the outer surface of the first receptacle and aligned with one guide strip of the plurality of guide strips.

9. The sizing toolkit of claim 7, further comprising at least one mounting bracket disposed on the stem, the at least one mounting bracket adapted to removably receive the second receptacle on the stem.

* * * * *